US007385599B2

(12) United States Patent
Mukai

(10) Patent No.: US 7,385,599 B2
(45) Date of Patent: Jun. 10, 2008

(54) INFORMATION DISPLAY

(75) Inventor: Tomohiro Mukai, Suwa (JP)

(73) Assignee: Seiko Epson Corporation (JP)

( * ) Notice: Subject to any disclaimer, the term of this patent is extended or adjusted under 35 U.S.C. 154(b) by 530 days.

(21) Appl. No.: 10/959,904

(22) Filed: Oct. 6, 2004

(65) Prior Publication Data

US 2005/0116911 A1 Jun. 2, 2005

(30) Foreign Application Priority Data

Oct. 7, 2003 (JP) ..... 2003-348054

(51) Int. Cl.
*G09G 5/00* (2006.01)

(52) U.S. Cl. ..... 345/204; 345/156; 345/169; 345/581; 345/660

(58) Field of Classification Search ..... 345/204, 345/473, 156–158, 163, 169, 589, 102, 87, 345/14, 16, 660, 99, 173, 199, 7, 2.2, 581, 345/100, 180; 348/373, 674, 211.9; 382/107, 382/167, 290, 170; 395/157; 358/471, 474
See application file for complete search history.

(56) References Cited

U.S. PATENT DOCUMENTS 4,118,703 A * 10/1978 Williams ..... 342/158
4,310,840 A * 1/1982 Williams et al. ..... 345/14
4,395,707 A * 7/1983 Satrapa ..... 345/180
4,807,158 A * 2/1989 Blanton et al. ..... 345/581
4,857,899 A 8/1989 Ishii
5,146,592 A * 9/1992 Pfeiffer et al. ..... 715/807
5,585,926 A * 12/1996 Fujii et al. ..... 358/471
5,659,404 A * 8/1997 Matsuda ..... 358/474
5,757,359 A * 5/1998 Morimoto et al. ..... 345/156
5,864,370 A * 1/1999 Knox et al. ..... 348/674
5,987,624 A * 11/1999 Eglit ..... 714/32
6,046,718 A * 4/2000 Suzuki et al. ..... 345/100
6,118,485 A * 9/2000 Hinoue et al. ..... 348/373
6,184,861 B1 2/2001 Callway
6,195,068 B1 * 2/2001 Suzuki et al. ..... 345/2.2
6,346,933 B1 * 2/2002 Lin ..... 345/157
6,512,507 B1 * 1/2003 Furihata et al. ..... 345/157
6,577,760 B1 * 6/2003 Ohta et al. ..... 382/167
6,961,082 B2 * 11/2005 Miura et al. ..... 348/211.9
6,977,630 B1 * 12/2005 Donath et al. ..... 345/7

(Continued)

FOREIGN PATENT DOCUMENTS

JP 06-083287 3/1994

(Continued)

OTHER PUBLICATIONS

International Search Report issued by Japan Patent Office as an International Searching Authority on Dec. 14, 2004.
Examination result issued in corresponding European application.

*Primary Examiner*—Prabodh Dharia
(74) *Attorney, Agent, or Firm*—Harness, Dickey & Pierce, P.L.C.

(57) ABSTRACT

An information display displays predetermined information on a display screen, the type of drawing element is detected for each pixel of the display screen (step S105), a brightness correction LUT is set based on the type of drawing element (step S106), and the brightness is corrected for each pixel based on the selected brightness correction LUT group (step S107).

2 Claims, 7 Drawing Sheets

U.S. PATENT DOCUMENTS

| | | | | |
|---|---|---|---|---|
| 6,996,447 | B2 * | 2/2006 | Onishi et al. | 700/108 |
| 7,046,232 | B2 * | 5/2006 | Inagaki et al. | 345/158 |
| 7,072,527 | B1 * | 7/2006 | Nako | 382/290 |
| 7,193,600 | B2 * | 3/2007 | Onishi et al. | 345/99 |
| 2001/0033260 | A1 * | 10/2001 | Nishitani et al. | 345/87 |
| 2002/0048389 | A1 * | 4/2002 | Komaki | 382/107 |
| 2002/0057238 | A1 * | 5/2002 | Nitta et al. | 345/87 |
| 2002/0089478 | A1 | 7/2002 | Yokobori | |
| 2003/0001815 | A1 | 1/2003 | Cui | |
| 2004/0066376 | A1 * | 4/2004 | Donath et al. | 345/169 |
| 2005/0025357 | A1 * | 2/2005 | Landwehr et al. | 382/170 |
| 2006/0279523 | A1 * | 12/2006 | Nitta et al. | 345/102 |

FOREIGN PATENT DOCUMENTS

| | | |
|---|---|---|
| JP | 09-307810 | 11/1997 |
| JP | 10-011025 | 1/1998 |
| JP | 2000-305545 | 11/2000 |
| WO | WO98/48571 | 10/1998 |

* cited by examiner

*FIG. 2*

| ADDRESS | BRIGHTNESS VALUE\| TYPE OF DRAWING ELEMENT | ADDRESS | BRIGHTNESS VALUE\| TYPE OF DRAWING ELEMENT | ADDRESS | BRIGHTNESS VALUE\| TYPE OF DRAWING ELEMENT | ADDRESS | BRIGHTNESS VALUE\| TYPE OF DRAWING ELEMENT |
|---|---|---|---|---|---|---|---|
| (0, 0) | 255, BACKGROUND | $(x_1, 0)$ | 255, BACKGROUND | $(x_2, 0)$ | 255, BACKGROUND | (799, 0) | 255, BACKGROUND |
| ~ | ~ | ~ | ~ | ~ | ~ | ~ | ~ |
| $(0, y_1)$ | 173, IMAGE | $(x_1, y_1)$ | 255, BACKGROUND | $(x_2, y_1)$ | 119, CHARACTER | $(799, y_1)$ | 87, CHARACTER |
| ~ | ~ | ~ | ~ | ~ | ~ | ~ | ~ |
| $(0, y_2)$ | 0, CHARACTER | $(x_1, y_2)$ | 119, CHARACTER | $(x_2, y_2)$ | 83, IMAGE | $(799, y_2)$ | 231, IMAGE |
| ~ | ~ | ~ | ~ | ~ | ~ | ~ | ~ |
| (0, 599) | 46, CHARACTER | $(x_1, 599)$ | 255, BACKGROUND | $(x_2, 599)$ | 255, BACKGROUND | (799, 599) | 255, BACKGROUND |

*F I G. 4*

| ILLUMINATION AREA | ILLUMINATION |
|---|---|
| A | ILLUMINATION<10lx |
| B | 10lx≦ILLUMINATION<100lx |
| C | 100lx≦ILLUMINATION |

*F I G. 6*

| ORIGINAL BRIGHTNESS VALUE | ILLUMINATION AREA A (ILLUMINATION<10lx) | ILLUMINATION AREA B (10lx≦ILLUMINATION<100lx) | ILLUMINATION AREA C (100lx≦ILLUMINATION) |
|---|---|---|---|
| 0 | 0 | 0 | 0 |
| 52 | 2 | 11 | 52 |
| 73 | 6 | 21 | 73 |
| 93 | 12 | 34 | 93 |
| 112 | 22 | 49 | 112 |
| 130 | 34 | 66 | 130 |
| 147 | 49 | 85 | 147 |
| 163 | 67 | 104 | 163 |
| 178 | 87 | 124 | 178 |
| 192 | 109 | 145 | 192 |
| 205 | 132 | 165 | 205 |
| 217 | 157 | 185 | 217 |
| 228 | 182 | 204 | 228 |
| 238 | 207 | 222 | 238 |
| 247 | 232 | 239 | 247 |
| 255 | 255 | 255 | 255 |

INFORMATION DISPLAY

BACKGROUND OF THE INVENTION

1. Field of the Invention

The present invention relates to an information display which displays predetermined information on a display screen.

2. Description of the Related Art

The conventional technology of this type is disclosed by, for example, Japanese Patent Laid-open Publication No. H6-83287 describing a liquid crystal display detecting the illumination of the surrounding portion of the display screen by an illumination sensor, and largely correcting the brightness of the gray-scale portion of a display target when the detected illumination is large, thereby improving the visibility of the image of a photograph, etc.

The technology of displaying a character on the above-mentioned liquid crystal display can be the technology (antialiasing) of displaying a smooth and readable character by representing the stroke width of a potion smaller than one pixel as a gray-scale outline of a character.

However, the former of the above-mentioned conventional technology simply, equally, and largely corrects the brightness of a gray-scale portion of a display target. Therefore, for example, if the outline of a character is represented as a gray-scale portion by antialiasing, the brightness of the stroke forming part of a character is corrected. As a result, the stroke width of a character is thinned, thereby lowering the visibility of the character.

The present invention has been developed to solve the problems of the conventional technology, and aims at providing an information display capable of improving the visibility of each display target.

SUMMARY OF THE INVENTION

To solve the above-mentioned problems, the information display of the present invention displays predetermined information on a display screen, detects the type of each drawing element displayed on the display screen, sets the brightness correction characteristic based on the type, and corrects the brightness for each display target based on the brightness correction characteristic.

The information display according to the present invention displays predetermined information on a display screen, and includes: a drawing element type detection section for detecting a type of drawing element for each pixel of the display screen; a characteristic setting section for setting the brightness correction characteristic based on the type of drawing element; and a brightness correction section for correcting the brightness for each pixel based on the brightness correction characteristic.

Furthermore, the display includes an illumination detection section for detecting the illumination of the surrounding portion of the display screen. The characteristic setting section can also set the brightness correction characteristic based on the illumination detected by the illumination detection section and the type of drawing element detected by the drawing element type detection section.

With the above-mentioned configuration, the brightness can be corrected for each type of display target of a character, an image, etc. or for each type of drawing element. Therefore, for example, each type of display target or the type of drawing element can be more appropriately corrected than the conventional technology of equally correcting the brightness without considering the type of display target. Thus, the present invention can successfully improve the visibility of each display target.

When the drawing element type detection section detects that the type of drawing element is a character, the characteristic setting section can set the brightness correction characteristic such that the smaller the illumination detected by the illumination detection section, the smaller the brightness of the gray-scale portion of the outline of a character.

With this configuration, when the surrounding portion of the display screen is bright and the illumination of the display screen is sufficiently high, the brightness of the gray-scale portion of the outline of a character can be maintained and a smooth and readable character can be displayed. When the surrounding portion of the display screen is dark, and the illumination of the display screen is not sufficiently high, the brightness of the gray-scale portion of the outline of a character is slightly corrected, thereby realizing the entirely deeper character. As a result, a high-contrast readable character can be displayed.

Furthermore, when the drawing element type detection section detects an image as a type of drawing element, the characteristic setting section can set the brightness correction characteristic such that the smaller the illumination detected by the illumination detection section, the smaller the correction of the brightness of the low gray-scale level portion which is equal to or lower than a predetermined brightness value, and the larger the correction of the brightness of the high gray-scale level portion which is larger than the predetermined brightness value.

With this configuration, when the surrounding portion of the display screen is bright and the illumination of the display screen is sufficiently high, the brightness of the image can be maintained and a natural image can be displayed. When the surrounding portion of the display screen is dark and the illumination of the display screen is not sufficiently high, the brightness of the low gray-scale level portion is reduced with the brightness of the high gray-scale level portion being enhanced, thereby displaying a high-contrast image to be displayed whose outline can be more easily grasped.

Each pixel has VRAM storing a type of drawing element and brightness, and the brightness correction section and the characteristic setting section set the brightness correction characteristic based on the type of drawing element stored in the VRAM, and the display control device can correct the brightness stored in the VRAM based on the brightness correction characteristic.

With this configuration, for example, the predetermined information about the brightness and the type of drawing element are stored in the main memory, and the increase of the load of the CPU can be avoided unlike the method of configuring the brightness correction section and the characteristic setting section by the CPU. Therefore, the consumption of the memory capacity and the calculation cost can be reduced. As a result, the present invention is preferable when applied to a mobile information terminal having small CPU and memory resources.

BRIEF DESCRIPTION OF THE DRAWINGS

FIG. 2 is an explanatory view of the data stored in the VRAM shown in FIG. 1;

FIG. 4 is an explanatory view showing the relationship between an illumination area and illumination;

FIG. 6 is an explanatory view of the character LUT; and

DESCRIPTION OF THE PREFERRED EMBODIMENTS

An embodiment of an information display according to the present invention is described below by referring to the attached drawings.

Figure 1:
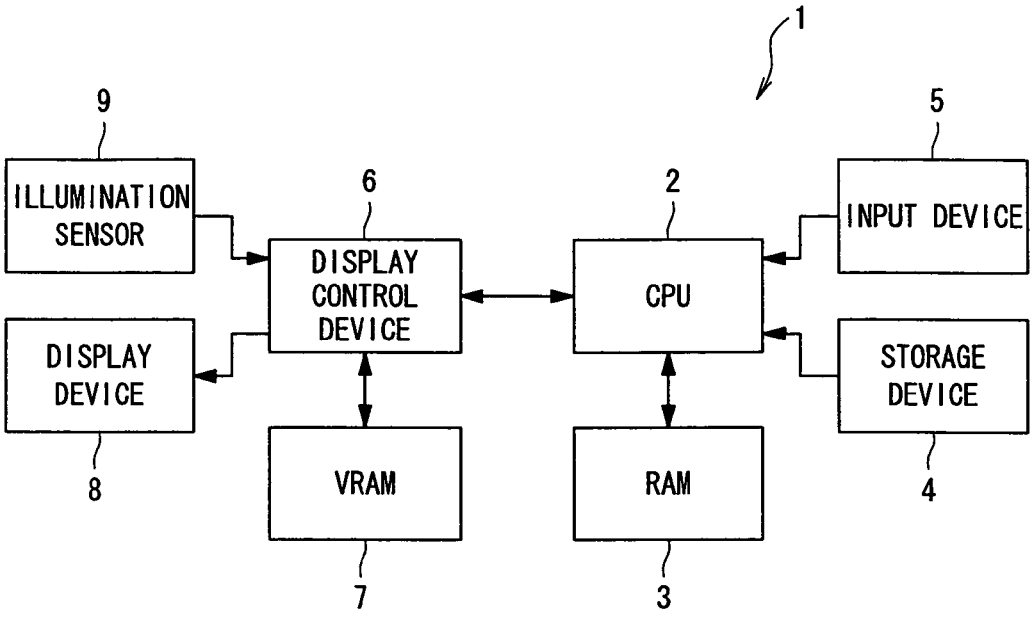
FIG. 1 shows the configuration of an embodiment of the information display according to the present invention.

FIG. 1 is a block diagram showing the outline of the configuration of a mobile information terminal 1. As shown in FIG. 1, the mobile information terminal 1 comprises a central processing unit (CPU) 2, random access memory (RAM) 3, a storage device 4, an input device 5, a display control device 6, a video RAM (VRAM) 7, a display device 8; and an illumination sensor 9.

In the components, the CPU 2 reads various programs such as a basic control program stored in the storage device 4 and data, processes the programs and data in a work area in the RAM 3, and performs control of each unit provided for the mobile information terminal 1. The CPU 2 also reads specified image data from the storage device 4 according to a pressed signal from the input device 5, and outputs the image data to the display control device 6.

When the CPU 2 performs the above-mentioned process according to each program, the RAM 3 forms a work area in which each program is processed. The RAM 3 also forms a memory area for processing data related to each process executed by CPU 2.

Furthermore, the storage device 4 stores a basic control program executed by the CPU 2, various application programs, and the data, etc. relating to each program. The storage device 4 outputs various programs and data to the CPU 2 according to a read request from the CPU 2. Various programs and data in the storage device 4 are stored by the CPU 2 in a readable and executable format.

The input device 5 comprises a keyboard, etc. having a character key, a number key, and various function keys. When any key of a keyboard is pressed, the input device 5 outputs a pressed signal corresponding to the pressed key to CPU 2.

Each time a predetermined time passes, the display control device 6 performs the image display process described later, processes the image data output from the CPU 2 into the raster data, and stores the pixel data forming the raster data and the type of drawing element which is the information about the type of drawing element corresponding to the pixel data at the address of the VRAM 7 corresponding to the (x, y) coordinates of the pixel corresponding to each pixel data as shown in FIG. 2. Based on the illumination of the display device 8 detected by the illumination sensor 9 and the type of drawing element stored in the VRAM 7, it corrects the pixel data stored in the VRAM 7, and outputs the corrected pixel data to the display device 8. The pixel data indicates the brightness value of each pixel on the display screen of the display device 8 by the values from "0" to "255", and "0" indicates that the brightness of the corresponding pixel is the lowest, and "255" indicates that the brightness of the corresponding pixel is the highest. The type of drawing element can be, for example, a character, an image, a background, etc. The outline of a character is represented as a gray-scale portion by antialiasing.

Furthermore, the VRAM 7 stores the pixel data and the type of drawing element at the addresses corresponding to the (x, y) coordinates of each pixel according to a write request from the display control device 6. The VRAM 7 outputs the pixel data and the type of drawing element to the display control device 6 according to a read request from the display control device 6.

The display device 8 is provided with a display screen such as an electro luminescence display (ELD), a liquid crystal display (LCD), etc., and displays predetermined information comprising a character, an image, etc. according to the pixel data output from the display control device 6.

The illumination sensor 9 detects the illumination of the surrounding portion of the display screen of the display device 8, and outputs the information about the detected illumination to the display control device 6.

Figure 3:
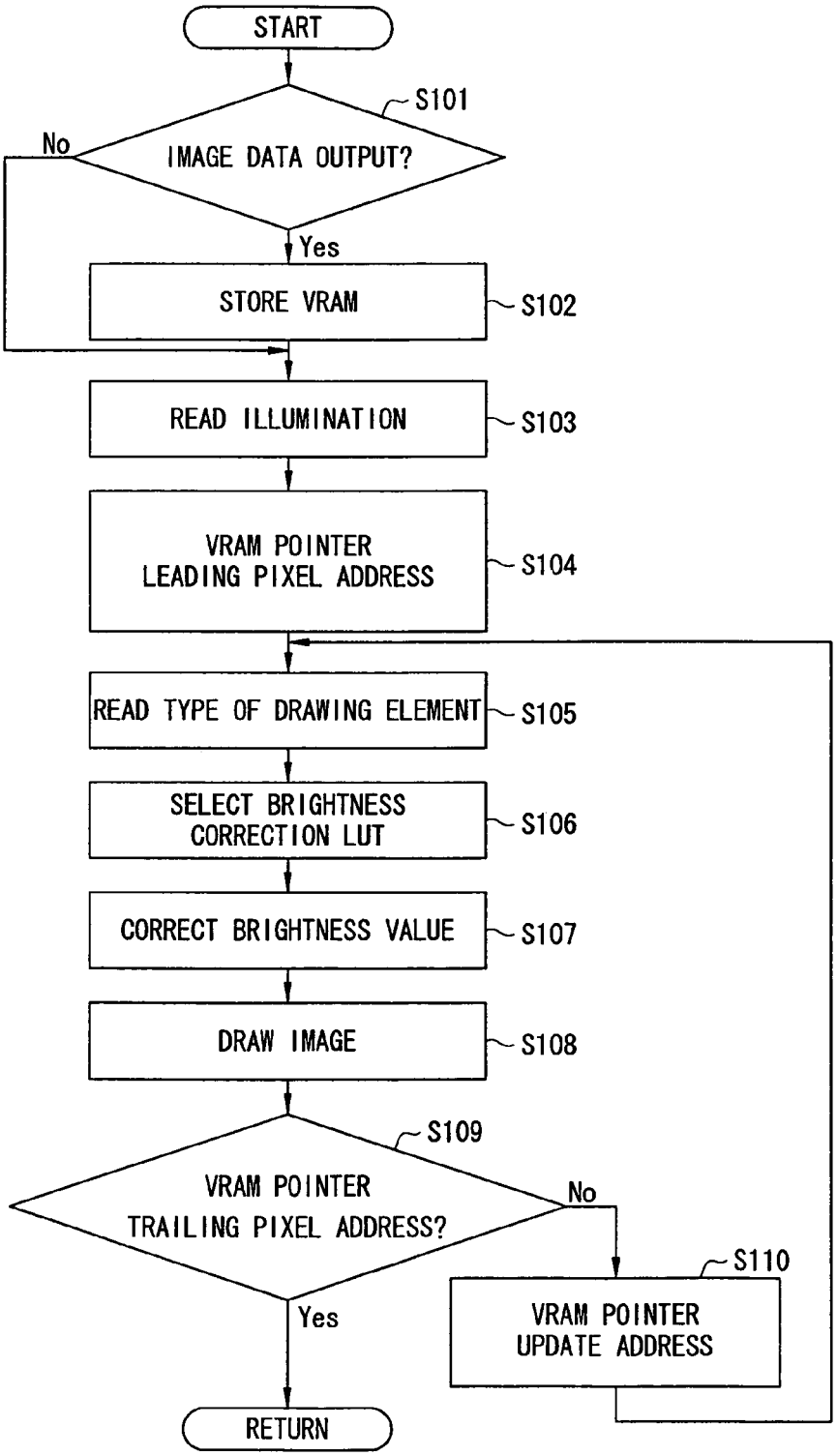
FIG. 3 is a flowchart of the image display process performed by the display control device.

FIG. 3 is a flowchart of the image display process executed by the display control device 6. The image display process is performed each time a predetermined time passes, and determines in step S101 whether or not image data is output from the CPU 2 as shown in FIG. 3. When image data is output (YES), control is passed to step S102. If not (NO), control is passed to step S103.

In step S102, the image data output from the CPU 2 is processed into raster data, and the pixel data forming the processed raster data and the type of drawing element corresponding to the pixel data are stored at the addresses of the VRAM 7 corresponding to the (x, y) coordinates of the pixel corresponding to the pixel data, and then control is passed to step S103.

In step S103, the illumination area is determined according to the information about the illumination output from the illumination sensor 9. Practically, as shown in FIG. 4, when the illumination is smaller than 10 l×, it is defined as an illumination area A (considerably dark environment such as a place under a street-lamp at night). When the illumination is 10 l× or more and lower than 100 l×, it is defined as an illumination area B (a rather dark environment such as the corner of a room at night). When the illumination is 100 l× and more, it is defined as illumination area C (a bright environment such as indoor and outdoor in the daytime).

Then, control is passed to step S104, and the pointer of the VRAM 7 is set at the address corresponding to the leading pixel (0, 0).

Then, control is passed to step S105 to read the type of drawing element stored at the address set by the pointer of the VRAM 7.

Figure 5A:
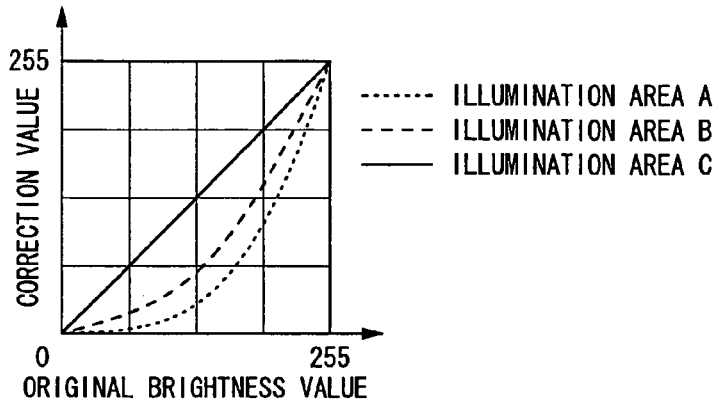
FIGS. 5A to 5C are explanatory views of the brightness correction LUT.
Figure 5B:
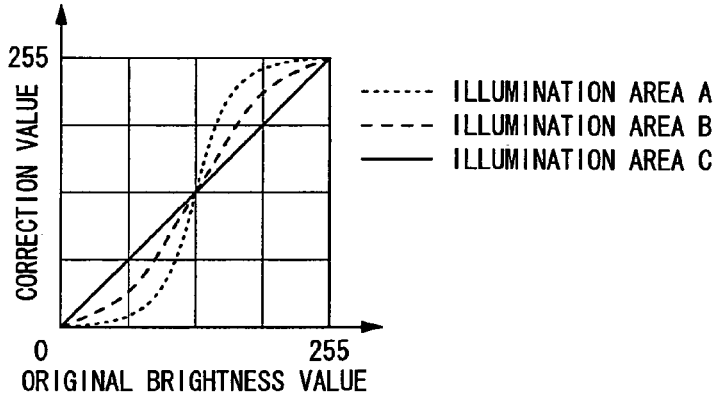
Figure 5C:
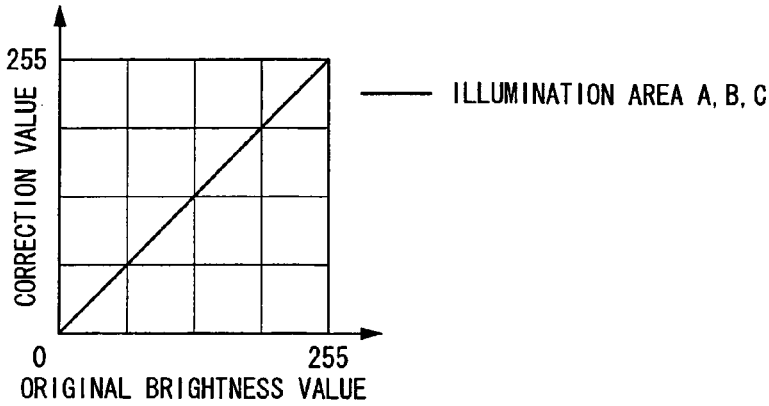

Then, control is passed to step S106 to select a brightness correction LUT group corresponding to the type of drawing element read in step S105 from among the character LUT group (lookup table) shown in FIG. 5A and FIG. 6, the image LUT group shown in FIG. 5B, and the background LUT group shown in of FIG. 5C. Then, from the selected brightness correction LUT group, the brightness correction LUT corresponding to the illumination areas A, B, and C detected in step S103 is selected.

As shown in FIG. 5A and FIG. 6, the character LUT group has the correction value of "0" when the brightness value is "0", and the correction value of "255" when the brightness value of "255". Each of the illumination areas A, B, and C has a corresponding LUT, and among them, in the LUT corresponding to the illumination area C, the correction value linearly increases with an increasing brightness value at the brightness value from "0" to "255". The LUT corresponding to the illumination area B appears as a convex curve under the increase with an increasing inclination with an increasing brightness value at the brightness value from "0" to "255". Furthermore, the LUT corresponding to the illumination area A has a smaller brightness value than the LUT corresponding to the illumination area B at the brightness value from "0" to "255". It appears as a convex curve under the increase with an increasing brightness value. That is, when the type of drawing element is a character, and when the illumination of the surrounding portion of the display screen decreases, the LUT for decreasing the brightness of the gray-scale portion is set in the brightness correction LUT group.

As shown in FIG. 5B, the image LUT group also indicates the correction value of "0" at the brightness value of "0", the correction value of "127" at the brightness value of "127", and the correction value of "255" at the brightness value of "255". The LUT corresponds to each of the illumination areas A, B, and C. Among them, the LUT corresponding to the illumination area C indicates the linear increase of the correction value with an increase of the brightness value at the brightness value from "0" to "255". The LUT corresponding to the illumination area B appears as a convex curve under the increase with the increasing inclination when the brightness value increases at the low gray-scale level portion having the brightness value from "0" to "127". At the high gray-scale level portion having the brightness value from "128" to "255", it appears as a convex curve over the increase with the decreasing inclination with the increase of the brightness value. Furthermore, the LUT corresponding to the illumination area A, with the brightness value from "0" to "127", the correction value is smaller than the LUT corresponding to the illumination area B, appears as a convex curve below the increase with an increasing inclination with the increase of the brightness value. At the brightness from "128" to "255", the correction value is larger than the LUT corresponding to the illumination area B, and it appears as a convex curve over the increase with a decreasing inclination with the increase of the brightness value. That is, when the type of drawing element is an image, the smaller the illumination of the surrounding portion of the display screen, the smaller brightness of the low gray-scale level portion, and the larger the brightness of the high gray-scale level portion, thus setting the LUT for brightness correction LUT.

As shown in FIG. 5C, the background LUT group is provided with a LUT corresponding to all illumination areas A, B, and C. The LUT indicates the correction value of "0" at the brightness value of "0", and the correction value of "255" at the brightness value of "255". At the brightness value between the values, the correction value linearly increases with the increasing value of the brightness value. That is, when the type of drawing element is background, the LUT that maintains the brightness value is set as a brightness correction LUT regardless of the illumination of the surrounding portion.

Then, control is passed to step S107, and the pixel data stored at the address set by the pointer of the VRAM 7 is read. The read pixel data is corrected according to the brightness correction LUT selected in step S106.

Then, control is passed to step S108, and the pixel data corrected in step S107 is output to the display device 8.

Then, control is passed to step S109, and it is determined whether or not the image can be displayed on all pixels, that is, whether or not the address corresponds to the trailing pixel (for example, when the resolution of the display screen is SVGA (super video graphics array) 800×600, it is (799, 599)) for which the pointer is predetermined. Then, the address corresponds to the trailing pixel (YES), the arithmetic operation is terminated. Otherwise (NO), control is passed to step S 110.

In step S110, the address of the pointer of the VRAM 7 is updated to the address corresponding to the pixel on the right when viewed from the front, and then control is passed to step S105. If there is no pixel on the right when viewed from the front, the address is updated to the address corresponding to the pixel on the left of the pixel group one row below when viewed from the front.

Then, the operations of the mobile information terminal 1 according to the present embodiment are explained below based on the practical situation.

Figure 7A:
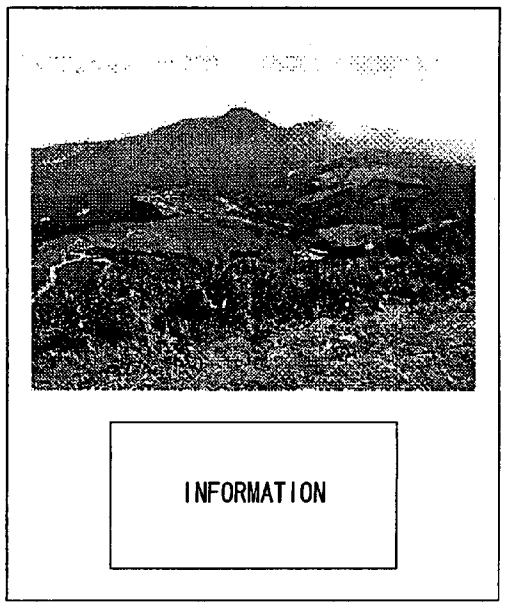
FIGS. 7A to 7C are explanatory views of an operation according to an embodiment of the present invention.

Assume that when the mobile information terminal 1 is used in a considerably dark environment such as a place under a street-lamp at night, and the illumination of the surrounding portion of the display screen is lower than 10 lx, the display control device 6 performs an image display process. Then, as shown in FIG. 3, the determination in step S101 is "NO", and in step S103, the illumination area A is detected according to the information about the illumination output from the illumination sensor 9. In step S104, as shown in FIG. 2, the pointer of the VRAM 7 is set as the address corresponding to the leading pixel (0, 0). In step S105, the type of drawing element (background) is read from the VRAM 7 based on the pointer. In step S106, as shown in FIG. 5C, a background LUT is selected based on the type of drawing element. In step S107, pixel data is read from the VRAM 7 based on the pointer, and the read pixel data is maintained as is based on the brightness correction LUT. In step S108, the maintained pixel data is output to the display device 8, the determination in step S109 is "NO", the pointer of the VRAM 7 is in step 110 updated, and the above-mentioned flow is repeated from step S105. When the pixel data is output from the display control device 6, the display device 8 displays the background at the leading pixel (0, 0) based on the output pixel data as shown in FIG. 7A in the display device 8.

Figure 7B:
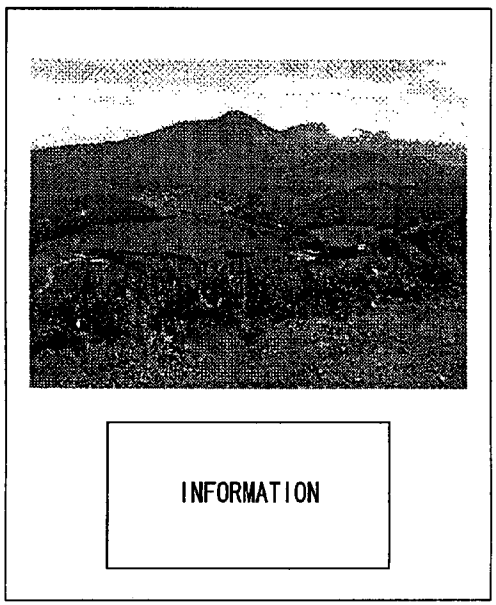
Figure 7C:
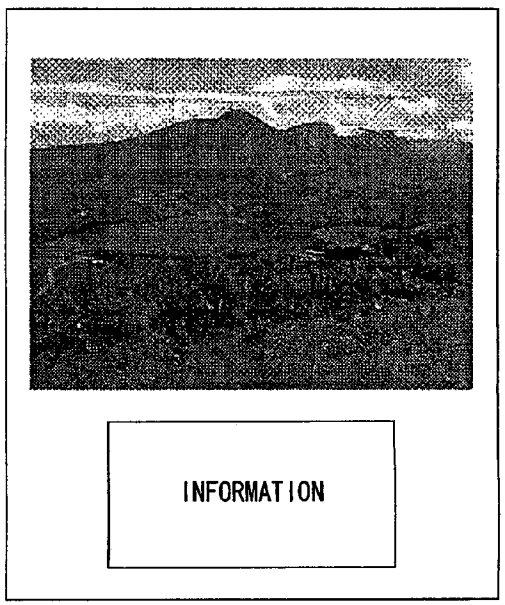

Assume that the pointer of the VRAM 7 is set to the address corresponding to the pixel (0, y1) during the repetition of the above-mentioned flow. Then, in step 105, the type of drawing element (image) is read from the VRAM 7 based on the pointer. In step S106, as shown in FIG. 5B, the brightness correction LUT corresponding to the illumination area A is selected from the image LUT group based on the type of drawing element. In step S107, the pixel data is read from the VRAM 7 based on the pointer, and according to the brightness correction LUT, when the read pixel data is low gray-scale level portion, the brightness is corrected to be lower. When it is high gray-scale level portion, the brightness is corrected to be higher. In step S108, the corrected pixel data is output to the display device 8, and the above-mentioned flow is repeatedly performed from step S105 through steps S109 and S110. When the pixel data is output from the display control device 6, the display device 8 displays a high-contrast image on the pixel (0, y1) based on the output pixel data as shown in FIG. 7A. If the mobile information terminal 1 is used in a rather dark environment such as the corner of a room at night, and the illumination of the display screen is an illumination area B, then an image lower in contrast than the illumination area A is displayed as shown in FIG. 7B. If the mobile information terminal 1 is used in a bright environment such as indoor and outdoor in the daytime, and the illumination of the display screen is an illumination area C, then an image whose brightness in the high gray-scale level portion and the low gray-scale level portion is maintained is displayed as shown in FIG. 7C.

Assume the pointer of the VRAM 7 is set to the address corresponding to the pixel (0, y2) during the repetition of the above-mentioned flow. Then, in step 105, the type of drawing element (character) is read from the VRAM 7 based on the pointer. In step S106, as shown in FIG. 5A, the brightness correction LUT corresponding to the illumination area A is selected from the character LUT group based on the type of drawing element. In step S107, the pixel data is read from the VRAM 7 based on the pointer, and according to the brightness correction LUT, when the read pixel data is a gray-scale portion, the brightness is corrected to be lower. In step S108, the corrected pixel data is output to the display device 8, and the above-mentioned flow is repeatedly performed from step S105 through steps S109 and S110. When the pixel data is output from the display control device 6, the display device 8 displays a high-contrast image on the pixel (0, y2) based on the output pixel data as shown in FIG. 7A. If the mobile information terminal 1 is used in a rather dark environment such as the corner of a room at night, and the illumination of the display screen is an illumination area B, then an image lower in contrast than the illumination area A is displayed as shown in FIG. 7B. If the mobile information terminal 1 is used in a bright environment such as indoor and outdoor in the daytime, and the illumination of the display screen is an illumination area C, then an image whose brightness in the high gray-scale level portion and the low gray-scale level portion is maintained is displayed as shown in FIG. 7C.

The brightness can be corrected for each type of drawing element of a character, an image, etc. in the module information terminal 1 of the present embodiment. Therefore, for example, the type of drawing element can be more appropriately corrected than the conventional technology of equally correcting the brightness without considering the type of display target. Thus, the present invention can successfully improve the visibility of each display target as shown in FIGS. 7A to 7C.

When the surrounding portion of the display screen is bright, and the illumination of the display screen is sufficiently high, the brightness of an image is maintained. Therefore, a natural image can be displayed. When the surrounding portion of the display screen is dark, and the illumination of the display screen is not sufficiently high, the brightness of the low gray-scale level portion is lowered while the brightness of the high gray-scale level portion is enhanced. Therefore, a high-contrast image can be obtained, and an image whose outline as display target is more easily grasped is obtained.

When the surrounding portion of the display screen is bright, and the illumination of the display screen is sufficiently high, the brightness of the gray-scale portion of the outline of a character is maintained. Therefore, a smooth and readable character can be displayed. When the surrounding portion of the display screen is dark and the illumination of the display screen is not sufficiently high, the gray-scale portion of the outline of a character is corrected to be smaller. Therefore, the entire character can be deep, and a high-contrast and readable character can be displayed.

Pixel data and a type of drawing element are stored in the VRAM 7, and the image display process is executed by the display control device 6. As a result, as compared with the conventional technology of performing the image display process by the CPU 2 by storing pixel data and the type of drawing element in the RAM 3, the load of the CPU 2 can be reduced, thereby reducing the consumption of the memory capacity and the computation cost.

In the conventional method of changing the font itself by thickening the stroke width of a character for smaller illumination after measuring the illumination of the surrounding portion of the display screen by the illumination sensor, preparing in advance a plurality of fonts and automatically generating a font are required, thereby largely consuming memory capacity and computation cost. Additionally, when re-rendering a font is repeated depending on the change in brightness, there occurs the problem of too large load of the mobile information terminal which is poor in resources such as memory, CPU, etc. and demands a high level of low power consumption. Furthermore, with the mobile information terminal 1 having the size of one character of 10×10 pixels to 20×20 pixels, changing a font itself brings about a too large change and undesired appearance for a user on the display.

According to the present embodiment, step S107 shown in FIG. 3 configures a brightness correction section, and similarly the step S105 shown in FIG. 3 configures a drawing element type detection section, step S106 shown in FIG. 3 configures a characteristic setting section, and the illumination sensor 9 shown in FIG. 1 and step S103 shown in FIG. 3 configure an illumination detection section.

The above-mentioned embodiments are only examples of the information display according to the present invention, and do not limit the configuration, etc.

For example, in the above-mentioned embodiment, pixel data and a type of drawing element are stored in the VRAM 7, and the image display process is performed by the display control device 6. However, the present invention is not limited to this application. For example, pixel data and a type of drawing element can be stored in the RAM 3, and the image display process can be performed by the CPU 2. With the configuration, although the consumption of the memory capacity is large, the display control device 6 and the VRAM 7 can be common units.

As a brightness correction LUT group, the LUT of γ curve and s curve is used. However, the present invention is not limited to this application. For example, a LUT of a folded line, lifting, indexed, etc. can also be applied.

The invention claimed is:

1. An information display which displays predetermined information on a display screen, and comprises: a drawing element type detection section for detecting a type of drawing element for each pixel of the display screen; a characteristic setting section for setting the brightness correction characteristic for each pixel of the display screen based on the type of drawing element;

a brightness correction section for correcting the brightness for each pixel based on the brightness correction characteristic; and an illumination detection section for detecting the illumination of the surrounding portion of the display screen, wherein the characteristic setting section sets the brightness correction characteristics based on the illumination detected by the illumination detection section and the type of drawing element detected by the drawing element type detection section, when the drawing element type detection section detects that the type of drawing element is a character, the characteristic setting section sets the brightness correction characteristic such that the smaller the illumination detected by the illumination detection section, the smaller the brightness of the gray-scale portion of the outline of a character, when the drawing element type detection section detects an image as a type of drawing element, the characteristic setting section sets the brightness correction characteristic such that the smaller the illumination detected by the illumination detection section, the smaller the correction of the brightness of the low gray-scale level portion which is equal to or lower than a predetermined brightness value, and the larger the correction of the brightness of the high gray-scale portion which is larger than the predetermined brightness vale, and the drawing element type is one of a character and an image, and pixel data and the type of a drawing element corresponding to the pixel data corresponding to the coordinate of the pixel corresponding to the pixel data.

2. The information display according to claim 1, wherein each pixel has VRAM storing a type of drawing element and brightness, and the brightness correction section and the characteristic setting section set the brightness correction characteristic based on the type of drawing element stored in the VRAM, and the display control device corrects the brightness stored in the VRAM based on the brightness correction characteristic.

* * * * *